US006053756A

United States Patent [19]

Flanigan et al.

[11] Patent Number: 6,053,756

[45] Date of Patent: Apr. 25, 2000

[54] INTERLOCK SAFETY DEVICE

[75] Inventors: Allen Flanigan; Vince Burkhart, both of San Jose, Calif.

[73] Assignee: Applied Materials, Inc., Santa Clara, Calif.

[21] Appl. No.: 09/072,309

[22] Filed: May 4, 1998

[51] Int. Cl.[7] ..... H01R 13/62

[52] U.S. Cl. ..... 439/315; 439/911

[58] Field of Search ..... 439/315–318, 439/911, 314, 312

[56] References Cited

U.S. PATENT DOCUMENTS

| | | | |
|---|---|---|---|
| 2,788,404 | 4/1957 | Wilde | 439/911 |
| 4,553,000 | 11/1985 | Appleton | 200/50 |
| 4,678,254 | 7/1987 | Le Magourou | 439/139 |
| 4,845,593 | 7/1989 | Brown et al. | 361/192 |
| 5,554,893 | 9/1996 | Oku | 307/119 |
| 5,680,926 | 10/1997 | Sandor et al. | 200/51.08 |

OTHER PUBLICATIONS

International Search Report for PCT/US99/09670, Aug. 10, 1999, 7 pages.

*Primary Examiner*—Steven L. Stephan
*Assistant Examiner*—Eugene G. Byrd
*Attorney, Agent, or Firm*—Thomason, Moser & Patterson

[57] ABSTRACT

The present invention generally provides a safety connector apparatus for making an electrical/power connection in an electrical/power system comprising an interlock cover disposed on a connecting end of a power cable, a housing disposed over a power connector, the housing having a cover receiving cavity and a switch adaptable to enable power transfer when the cover is safely and securely locked by the cover lock.

20 Claims, 4 Drawing Sheets

INTERLOCK SAFETY DEVICE

BACKGROUND OF THE INVENTION

1. Field of the Invention

The present invention relates to the field of electrical safety connectors. More particularly, the present invention relates to an electrical connector incorporating a locking device and a manually activated enabling switch that ensures power transfer only when the connector is locked.

2. Background of the Related Art

To prevent arcing or possible explosions, insulated cables are generally used to conduct power to systems, such as plasma processing systems, that require high power or high voltage. However, the conductors in the cables are necessarily exposed at the cable ends that connect to the power source and to the equipment to be energized. If a cable becomes disconnected at the equipment but still connected to the power source, the disconnected cable end presents a safety hazard because of the resulting exposed live conductor.

One known solution to preventing a live open end on a connecting cable generally involves a cover plate that secures the cable on a piece of equipment and a safety shut-off switch that disables a power source when the cover plate is removed. FIG. 1 is a perspective view of a cable 4 connected to a piece of equipment 7, a safety shut-off switch 2 and a cover plate 8 that activates the safety shut-off switch 2 and secures the cable 4 on the piece of equipment 7. The safety shut-off switch 2 is electrically connected to a power source (not shown) and disables the power source when the switch is in its normal position. The safety shut-off switch 2 enables the power source only when the switch is pushed to a depressed position as shown by dashed lines 2'. The cable 4, typically having protruding male connectors, is inserted into a female connector 6 disposed on the piece of equipment 7. The cover plate 8 is then mounted over the safety shut-off switch 2 and the cable 4 on the piece of equipment 7 by fasteners 9, such as a bolt or screw, to prevent the cable 4 from becoming disconnected to the piece of equipment 7 and to push the safety shut-off switch 2 to the depressed position 2' that enables engagement of the power source. When the cover plate 8 is removed from the piece of equipment 7, the safety shut-off switch 2 reverts to the normal position and disables the power source. Thus, no power is delivered through the cable 4, and no safety hazards are presented when the cable 4 is disconnected from the piece of equipment 7.

Although the above-described switching mechanism provides the desired protection, it has many drawbacks. One drawback associated with the cover plate 8 is the substantial effort and time required to position and fasten the cover plate 8 on the piece of equipment 7, particularly when a number of cables and cover plates must be attached for installation and detached for operation and maintenance of a system of equipment. The effort and time required to mount the cover plate 8 leads to a safety problem. The cumbersome nature of mounting the cover plate 8 often entices operators who work with the high voltage equipment to defeat the safety shut-off switch 2 and bypass the safety mechanism (i.e. the cover plate and the safety shut-off switch) in an effort to save time and effort. The safety-shut off switch 2 is generally easy to defeat, such as by taping the switch to hold the switch in the depressed position that enables the power source. Bypassing the safety mechanism often leads to an omission of the cover plate 8 that allows a cable 4 to easily disconnect from the piece of equipment 7 and expose a live end connector that presents a serious safety hazard.

Accordingly, there is a need for a cable connector safety device that is simple to implement and that is not easily defeated or bypassed to ensure that the safety device enables the power source only when the cable connector is locked and disables the power source when the cable connector is disconnected from the piece of equipment.

SUMMARY OF THE INVENTION

The present invention generally provides a safety connector apparatus for making an electrical/power connection in an electrical/power system comprising: an interlock cover disposed on a connecting end of a power cable; a housing disposed on a power source, the housing having an interlock cover receiving cavity; a cover lock disposed adjacent the interlock cover receiving cavity; and a switch to enable power transfer when the cover is disposed in the housing. Once inserted in the cover receiving cavity of the housing, the interlock cover may be rotated to an enabling position, where the interlock cover is locked in the receiving cavity. A switch within the housing detects when the interlock cover is positioned within the receiving cavity to enable the electrical system only when the interlock cover is positioned at the enabling position. Otherwise, the switch disables the electrical system. By enabling the electrical system only when the interlock cover is in the enabling position, the safety connector apparatus ensures that the connection between the cable and the electrical connector is safely and securely locked when the electrical system is enabled.

In one aspect of the invention, the safety connector apparatus provides an interlock cover attached to a connecting end of a cable. The interlock cover preferably includes a pair of detents extending radially outward from the cover. The detents, in combination with corresponding recesses in the interlock cover receiving cavity, serve as part of a locking mechanism to lock the cover in the receiving cavity. The detents also serve as a triggering mechanism to actuate the switch when the cover is locked in the interlock cover receiving cavity.

Another aspect of the invention provides a housing having a cover receiving cavity in the shape of the outline or cross sectional shape of the interlock cover. Preferably the housing includes detent receiving grooves on a side wall of the receiving cavity serving as part of the locking mechanism. The housing preferably also includes a switch cavity wherein a switch is disposed.

A further aspect of the invention provides a method for ensuring that the connection between the cable and the electrical connector is securely and safely locked when the electrical system is enabled comprising: providing a cover mounted at the connecting end of the power cable; providing a housing disposed on a power supply, the housing having a cover receiving cavity; providing a cover lock disposed adjacent the cover receiving cavity; providing a switch to enable power transfer when the cover is locked in the cover receiving cavity; connecting the connecting end of the power cable to the power connector while inserting the cover into the cover receiving cavity; and locking the cover to control the switch to enable power transfer.

BRIEF DESCRIPTION OF THE DRAWINGS

So that the manner in which the above recited features, advantages and objects of the present invention are attained and can be understood in detail, a more particular description of the invention, briefly summarized above, may be had by reference to the embodiments thereof which are illustrated in the appended drawings.

It is to be noted, however, that the appended drawings illustrate only typical embodiments of this invention and are therefore not to be considered limiting of its scope, for the invention may admit to other equally effective embodiments.

DETAILED DESCRIPTION OF THE PREFERRED EMBODIMENT

Figure 3:
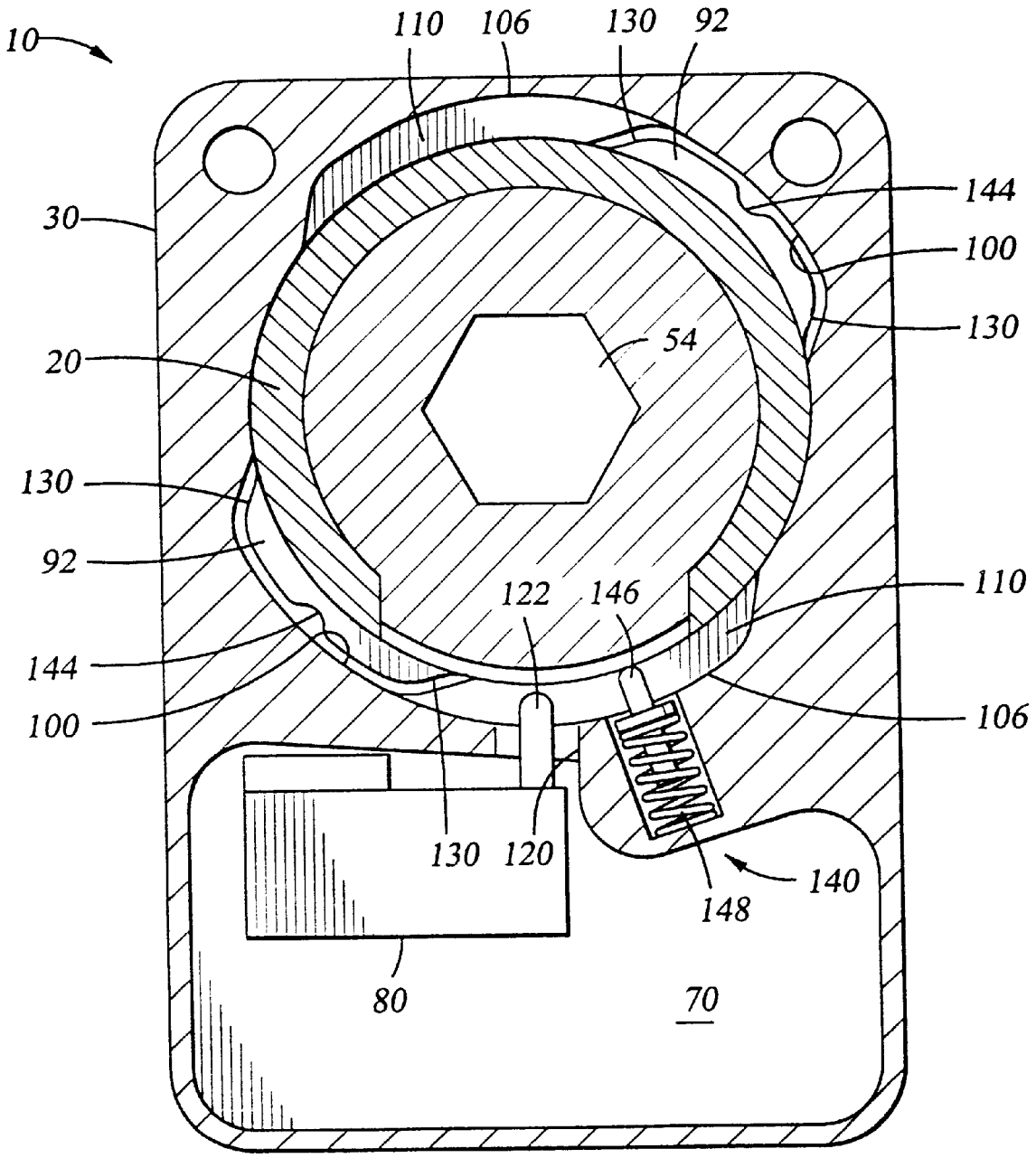
FIG. 3 is a partial cross sectional elevational back view of the safety connector apparatus showing the interlock cover in a receiving position.
Figure 4:
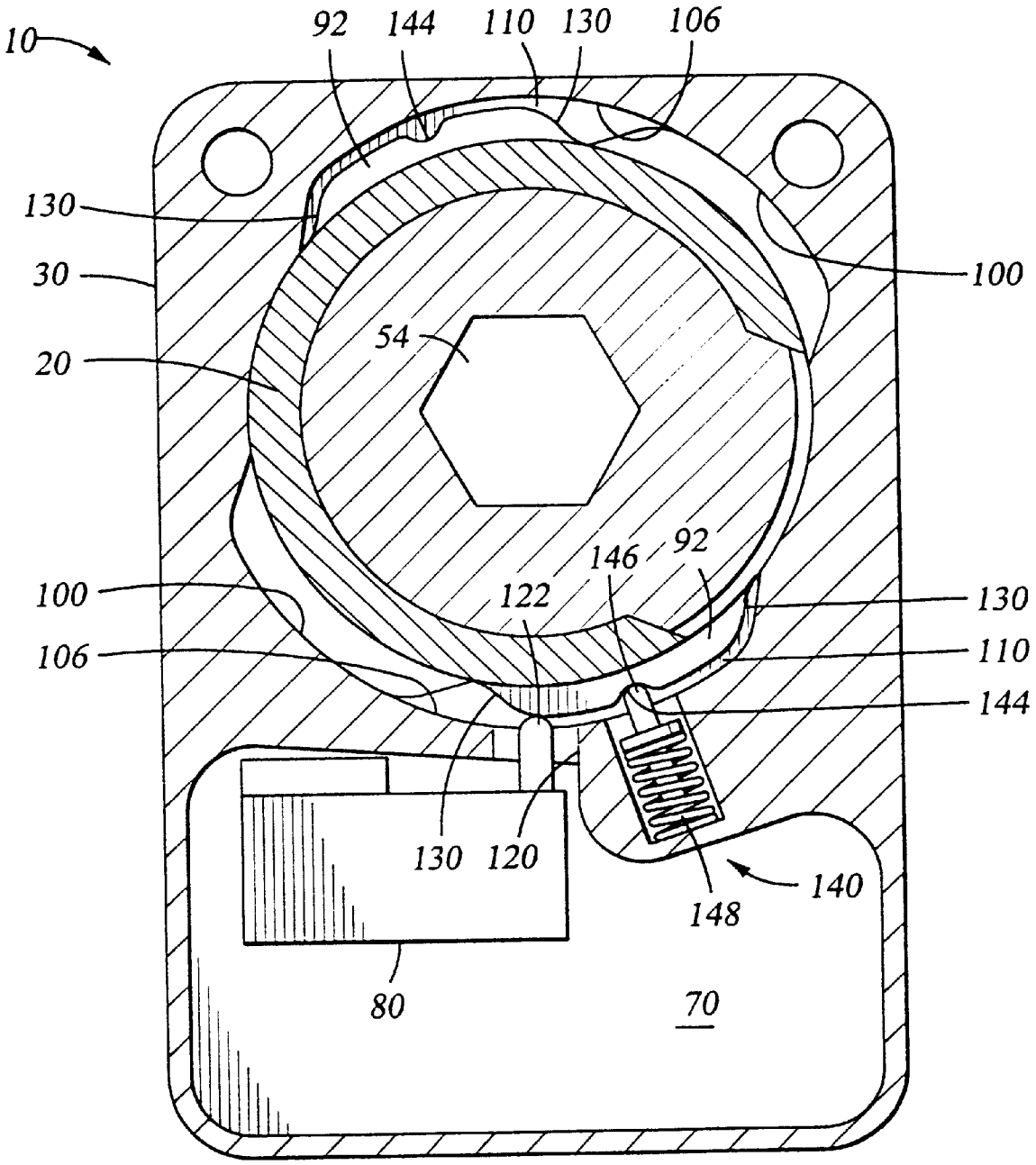
FIG. 4 is a partial cross sectional elevational back view of the safety connector apparatus showing the interlock cover in an enabling position.

Referring to FIGS. 24, the invention generally provides a safety connector apparatus 10 for making an electrical/power connection in an electrical/power system that provides a housing 30 defining a receiving cavity 40 adapted to receive an interlock cover 20 attached to the connecting end 52 of a cable 50 therein. The interlock cover 20 and the receiving cavity 40 are engageable with each other in a receiving position (as shown in FIG. 3) and an enabling position (as shown in FIG. 4). The receiving position allows insertion and removal of the interlock cover 20 into and out of the receiving cavity 40. Once inserted in the receiving cavity 40, the interlock cover 20 may be rotated between the receiving position and the enabling position. However, when in the enabling position in the receiving cavity 40, the interlock cover 20 is locked and cannot be removed from the receiving cavity 40 without first returning the interlock cover 20 to the receiving position. A switch 80 within the housing 30 is actuated to enable the electrical system only when the interlock cover 20 is in the enabling position. Otherwise, the switch 80 disables the electrical system. By enabling the electrical system only when the interlock cover 20 is in the enabling position, the safety connector apparatus 10 ensures that the connection between the cable 50 and the piece of equipment is securely and safely locked when the electrical system is enabled, and the safety connector apparatus 10 prevents a disconnected cable 50 from having a hazardous live end.

An electrical system typically includes cables connected to a power source or between equipment components for the transmission of power. A cable generally has opposing ends terminated with connectors. Alternatively, the cable has one end permanently connected to a piece of equipment and one end terminated with a connector. A connecting end of the cable preferably includes an electrical conductor that is adapted to mate with a matching electrical conductor on a piece of equipment or power source to transmit power therebetween. Typically, the mating electrical conductors include one male conductor that protrudes into a female conductor. Although the figures show the electrical conductor attached to the connecting end of the cable as being a male conductor, the present invention is equally applicable to connecting arrangements wherein the female connector is attached to the cable and to other types or arrangements of electrical conductors.

Figure 1:
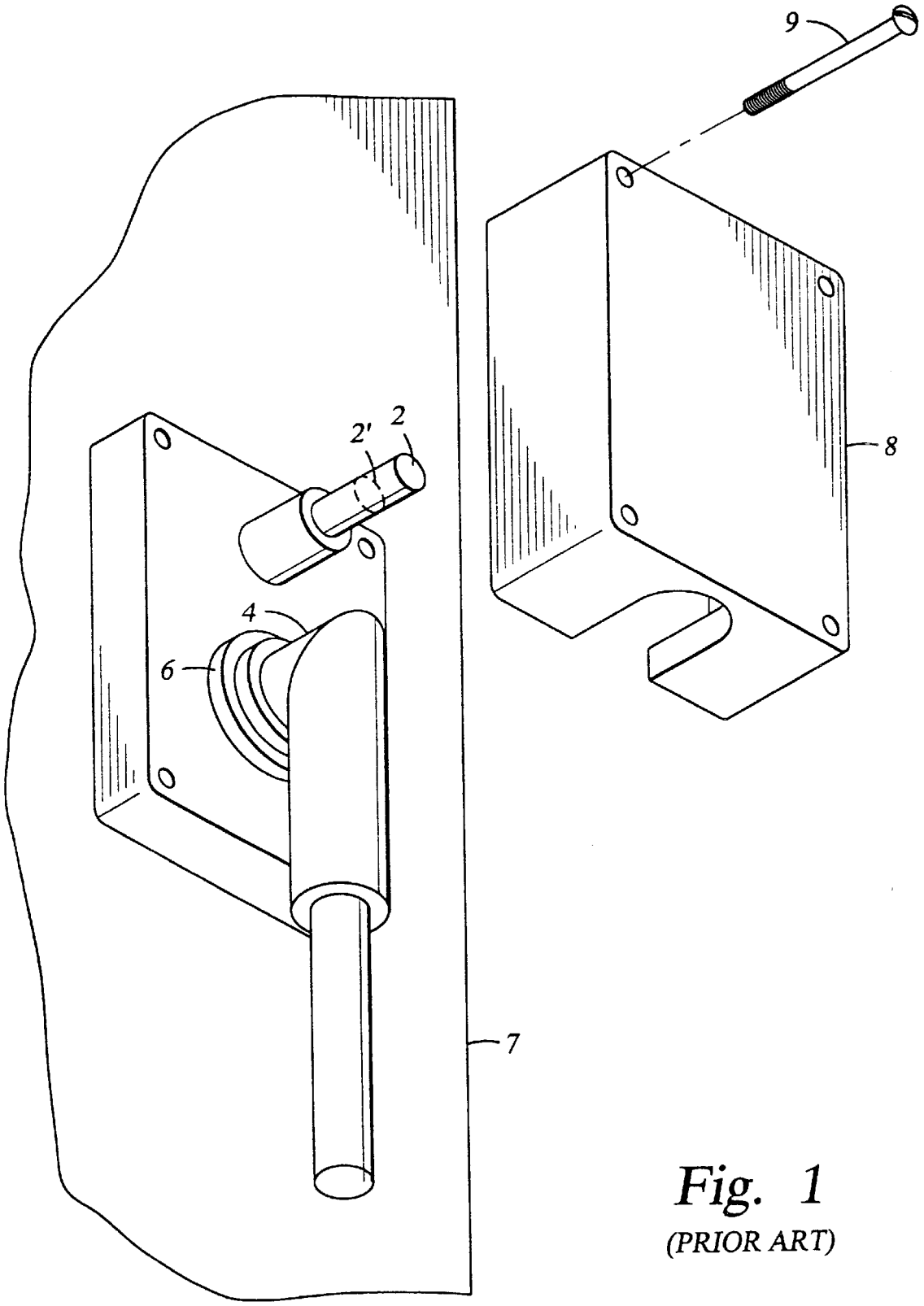
Fig. 1 (PRIOR ART)
FIG. 1 is a perspective view of a cable connected to a piece of equipment, a safety shut-off switch and a cover plate that activates the switch and secures the cable on the piece of equipment.
Figure 2:
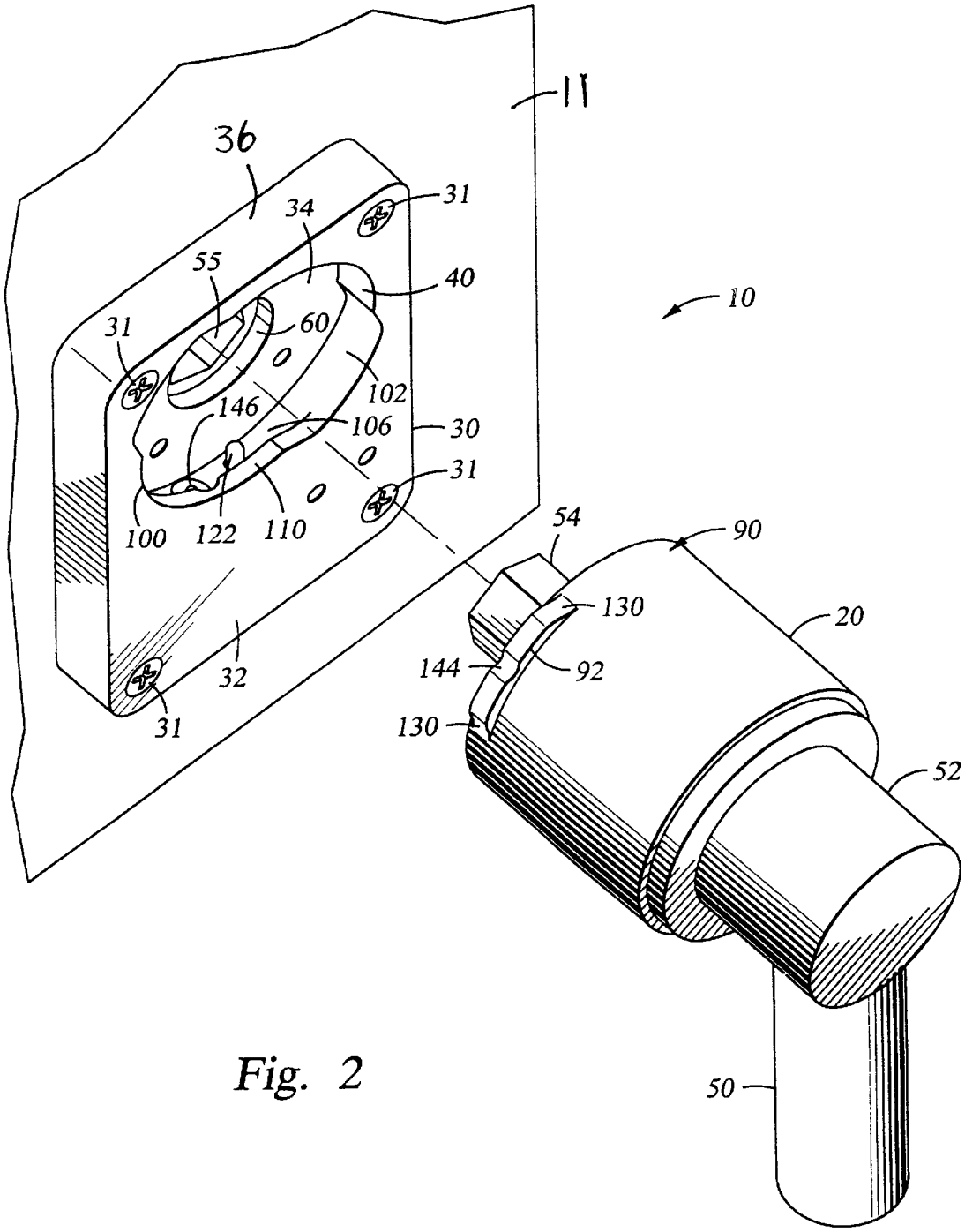
FIG. 2 is a substantially frontal perspective view of a safety connector apparatus according to the invention.

FIG. 2 is a perspective view of a safety connector apparatus 10 comprising an interlock cover 20 and a housing 30. In general, the housing 30 includes a front plate 32, a back plate 34 and a housing body 36. Alternatively, the housing 30 includes only a front plate 32 and a housing body 36, without the back plate 34. The front plate 32 includes a receiving cavity 40 matching the cross sectional shape of the interlock cover 20, and the back plate 34 includes an opening 60 to allow connection of a male electrical conductor 54 of the cable 50 to a female electrical conductor 55 disposed on the piece of equipment. Accordingly, the opening 60 has a diameter that is greater than the outer dimensions of the electrical conductor 54. The housing 30 is secured on a side wall 11 of a piece of equipment by fasteners 31 such as screws and bolts.

The interlock cover 20 is rotatably attached to the cable 50 at the connecting end 52 and surrounds the electrical conductor 54 to provide a protective cover for the electrical conductor 54. With the interlock cover 20 positioned over the electrical conductor 54 and the interlock cover 20 locked into the receiving cavity 40 of the housing 30, the electrical conductor 54 connects to the female electrical conductor 55 on the piece of equipment and is fully covered. The conductor 54 transfers power from a power source to the piece of equipment. The embodiment for the interlock cover 20 as disclosed in FIG. 2 is removably attached to the connecting end 52 of the cable 50 and, therefore, may be retrofitted over other electrical conductors or cables. The removable interlock cover 20 includes an axial bore therethrough that is sized to receive the electrical cable 50 therein. Alternatively, the interlock cover 20 can be permanently secured by crimping or other securing methods to the cable 50. Also, the interlock cover 20 can be adapted to any cross sectional shapes including but not limited to circular, oval and rectangular cross sections.

The interlock cover 20 has a generally circular cross sectional shape with at least one detent 92 extending radially outward from the circumference of the interlock cover 20. The detent 92 is disposed on the insertion end 90 of the interlock cover 20 and extends about an arcuate portion of the interlock cover 20 only. In the preferred embodiment, the interlock cover 20 includes two detents 92 diametrically disposed on opposite sides of the interlock cover 20. The detents 92 have similar shapes and sizes so that the outer cross sectional shape of the insertion end 90 of the interlock cover 20 is substantially symmetrical about a center dividing line. Alternatively, the detents 92 are shaped differently along with the corresponding receiving cavity 40 so that the interlock cover 20 can be inserted only in that particular matching receiving cavity in a particular orientation. Preferably, the detent 92 includes tapered ends 130 to provide a gradual depression of a switch pin 122 when the interlock cover is rotated in the receiving cavity 40. A notch 144 is positioned about the center of the detent 92 to receive a poisition indicator pin 146.

The receiving cavity 40 extending through the front plate 32 of the housing 30 preferably has an outer portion 100 and an side wall 102. The outer portion 100 defines an orifice in the front plate 32 of the housing 30 through which the interlock cover 20 may pass. The cross sectional shape and size of the outer portion 100 are substantially similar to the outer cross sectional shape (or outline) and size of the interlock cover 20 so that the interlock cover 20 must be aligned with the outer portion 100 of the receiving cavity 40 before the interlock cover 20 can be inserted into the receiving cavity 40. The detents 92 create an outer cross sectional shape for the interlock cover 20 that restricts the allowable positioning of the interlock cover 20 during its placement in the receiving cavity 40 through the orifice created by the outer portion 100 in the front 32 of the housing 30. Hereinafter, alignment of the interlock cover 20 with the outer portion 100 of the receiving cavity 40 shall be referred to as the receiving position. When in the receiving position, the interlock cover 20 may be inserted into and removed from the receiving cavity 40.

The side wall 102 of the receiving cavity 40 generally extends from the front plate 32 to the back 34 along the cross sectional shape (or outline) of the outer portion 100. Preferably, the side wall 102 extend a minimal depth so that the conductor 54 must be completely inserted and mated with the conductor 55 before the interlock cover may rotate within the receiving cavity. The side wall 102 of the receiving cavity 40 preferably includes a pair of detent receiving grooves 106 extending in a direction along the outline of the receiving cavity 40. The radial depth of the detent receiving grooves 106 are greater than the height of the detents 92 as measured from the circumference of the interlock cover 20. The detent receiving grooves 106 are aligned to receive the detents 92 when the interlock cover 20 is rotated from the receiving position to the enabling position.

The detent receiving grooves 106 have an arcuate length that is greater than the arcuate length of the detents 92 so that, once the insertion end 90 of the interlock cover 20 is placed in the receiving cavity 40, the interlock cover 20 may rotate therein. However, the detent receiving grooves 106 do not intersect one another. The detent receiving grooves 106 are positioned on opposite sides of the receiving cavity 40 and have a similar shape and size. Preferably, each of the detent receiving grooves 106 has an arcuate length that is at least the arcuate length of each of the detents 92 and thus allow the interlock cover 20 to rotate sufficiently in the receiving cavity 40. However, the detent receiving grooves 106 preferably restrict the rotation of the interlock cover 20 to one direction from the receiving position. Because the detent receiving grooves 106 do not intersect one another, the rotation of the interlock cover 20 within the receiving cavity 40 is limited as the detents 92 reach the end of the detent receiving grooves 106. Preferably, the detent receiving grooves 106 have an arcuate length that allows the interlock cover 20 to rotate in the side wall 102 of the cavity between about forty-five (45°) degrees and about ninety (90°) degrees (a quarter turn) from the receiving position.

The portion of the front plate 32 extending partially over the detent receiving grooves 106 defines an overhanging restraining lip or cover lock 110. When the interlock cover 20 is positioned in the receiving cavity 40 and rotated from the receiving position, the restraining lip 110 overhangs the detents 92 and maintains the interlock cover 20 in the receiving cavity 40. The detents 92 have a thickness that is less than the depth of the side wall 102 of the receiving cavity 40, but sufficient to withstand a considerable pulling force applied thereon. The restraining lip 110 is similarly substantially thick so as to withstand a considerable pulling force and maintain the interlock cover 20 in the receiving cavity 40. Additionally, the height of the detents 92 is sufficiently high, and the tolerances of the interlock cover 20, the detents 92, the outer portion 100 and the side wall 102 of the receiving cavity 40 are sufficiently tight to ensure that the interlock cover 20 may not be pulled from the receiving cavity 40 unless the interlock cover 20 is in the receiving position.

FIG. 3 is partial cross sectional back view of the safety connector apparatus 10 showing the interlock cover 20 inserted in the receiving cavity 40 in a receiving position. FIG. 4 is similar to FIG. 3, but shows the interlock cover 20 rotated within the receiving cavity 40 to an enabling position. The housing 30 preferably includes a switch cavity 70 adjacent to the receiving cavity 40. A switch pin passageway 120 extends between the switch cavity 70 and the receiving cavity 40, intersecting one of the detent receiving grooves 106 at a position offset from the entrance passageway 108.

A switch 80 is preferably positioned in the switch cavity 70. The switch 80 preferably includes a switch pin 122 that is movable between an extended, disable position and a retracted, enable position. The switch 80 is adapted to disable the electrical system when the switch pin 122 is extended, and the switch 80 is biased toward the extended position. When the switch pin 122 is forced to a retracted position, the switch 80 is adapted to enable the electrical system. Typically, a return electrical conductor or cable is connected from the switch 80 to the power source, and when the switch 80 is engaged in the depressed position, the switch 80 completes a control circuit that enables the power source. The switch pin 122 of the switch 80 extends through the switch pin passageway 120 and into the detent receiving groove 106 so that the switch pin 122 can detect the presence of the detent 92 in the detent receiving groove 106. As the interlock cover 20 rotates in the receiving cavity 40, the tapered ends 130 on the detents 92 gradually push the switch pin 122 from the extended position to the retracted position.

Generally, herein the term enabling position refers to the position of the interlock cover 20 when it is inserted in the receiving cavity 40 and rotated sufficiently from the receiving position such that the detent 92 forces the switch pin 122 into the retracted position. When the interlock cover 20 is in the enabling position, the electrical system is enabled. However, as previously mentioned, the detent receiving grooves 106 are adapted to permit rotation of the interlock cover 20 in the receiving groove by about forty five to about ninety degrees from the receiving position and the detent receiving grooves 106 do not intersect one another so the rotation of the interlock cover 20 is limited. Thus, in the specifically described embodiment of the invention, the term enabling position more specifically refers to the position of the interlock cover 20 in the receiving cavity 40 when it is rotated as far from the receiving position as the detent receiving grooves 106 permit (as shown in FIG. 4). The switch pin 122 is positioned and adapted to detect the detent 92 when the interlock cover 20 is in the enabling position, particularly when the interlock cover 20 is fully rotated from the receiving position.

To ensure that the interlock cover 20 is fully rotated to the enabling position, the safety connector apparatus 10 preferably includes a tactile position indicator 140 adapted to indicate when the interlock cover 20 is in the enabling position. In the preferred embodiment, the tactile position indicator 140 comprises a spring detent 146 that extends into the detent receiving groove 106. A notch 144 on a surface of the detent 92 aligns with the spring detent 146 when the interlock cover 20 is in the enabling position. Each detent 92 preferably includes a notch 144 having slanted sides such as a conical recess positioned intermediate the ends 130 of the detent 92, preferably at the center of the detent 92. The spring detent 146 is biased to an extended position by a spring 148 and is movable axially. As the interlock cover 20 rotates to the enabling position, the detent 92 contacts and forces the spring detent 146 from the extended position. When the interlock cover 20 is fully rotated to the enabling position, the spring detent 146 extends into the notch 144, and the biasing force of the spring 148 produces a slight resistance to rotation that may be felt by a user to indicate that the interlock cover 20 is in the fully rotated enabling position.

In operation, it is desired to safely complete an electrical connection between a cable 50 having the electrical conductor 54 at its connecting end 52 and a matching electrical connector functionally attached to a piece of equipment, such as a power source. To provide the desired safety, the electrical connectors must be fully inserted/mated and securely and safely locked before the power source is enabled.

The housing 30 is mounted onto a piece of equipment with the opening 60 aligned with the electrical connection of the equipment. With no interlock cover 20 in the receiving cavity 40, the switch pin 122 of the switch 80 is extended causing the switch 80 to disable the electrical system. The electrical conductor 54 and the interlock cover 20 is inserted into the receiving cavity 40 to the receiving position as shown in FIG. 3. With the electrical conductor 54 fully inserted into the electrical connector, the interlock cover 20 is rotated to the enabling position as shown in FIG. 4. As the interlock cover 20 rotates, the detents 92 force the switch pin 122 from the extended position to the retracted position, causing the switch 80 to enable the electrical system through a return conductor that completes a control circuit that enables the power source. Also, as the interlock cover 20 rotates to the enabling position, the detent 92 forces the spring detent 146 to a retracted position until the spring detent 146 encounters the notch 144 of the detent 92. The spring detent 146 enters the notch 144 and provides a slight resistance to further rotation that is sufficient to be felt by an operator rotating the interlock cover. While in the enabling position, the restraining lip or cover lock 110 prevents removal of the interlock cover 20 from the receiving cavity 40, and the electrical connection is safely and securely locked by the housing 30 and the interlock cover 20.

Disconnection of the electrical connection simply requires reversal of the insertion procedure. The interlock cover 20 is rotated from the enabling position to the receiving position and is pulled from the receiving cavity 40. After rotating to the receiving position, the detents 92 cease contact with the switch pin 122, allowing the switch pin 122 to return to the extended position which causes the switch 80 to disable the electrical system. Because the safety connector apparatus 10 only enables the system when the interlock cover 20 is in the enabling position, the safety connector apparatus 10 ensures that the interlock cover 20 and the electrical conductor 54 is safely and securely locked in the receiving cavity 40 of the housing 30 when the power source is enabled.

While the foregoing is directed to the preferred embodiment of the present invention, other and further embodiments of the invention may be devised without departing from the basic scope thereof, and the scope thereof is determined by the claims which follow.

We claim:

1. A safety interlocking apparatus for connecting a power cable to a power connector comprising:

a) a cover disposed on a connecting end of a power cable;

b) a housing having a cover receiving cavity; and c) a switch at least partially disposed in the cover receiving cavity and engageable by the cover to enable power transfer when the cover is inserted into the cover receiving cavity.

2. The apparatus of claim 1, further comprising:

d) at least one detent extending radially outward from the cover to activate the switch.

3. The apparatus of claim 2 further comprising a cover lock disposed adjacent the cover receiving cavity.

4. The apparatus of claim 3 wherein the cover lock comprises a front plate on the housing having an opening defined by an outline of the cover with the detent and at least one detent receiving groove on a side wall of the cover receiving cavity.

5. The apparatus of claim 4 wherein the cover is a cylinder rotatably mounted on a connecting end of a power cable.

6. The apparatus of claim 5 wherein the cover has first and second detents diametrically disposed on the cover.

7. The apparatus of claim 5 wherein the first and second detents have different shapes and the cover receiving cavity is correspondingly shaped to the outline of the cover with the differently shaped detents.

8. The apparatus of claim 2 wherein the switch is disposed adjacent the receiving cavity in a switch cavity.

9. The apparatus of claim 8 wherein the switch is enabled by a detent moving into a detent receiving groove within the cover receiving cavity.

10. The apparatus of claim 9 wherein the switch has a switch pin detecting the detent moving into the detent receiving groove.

11. The apparatus of claim 2 further comprising:

e) a cover position indicator disposed adjacent the cover receiving cavity to signal the cover in a locked position.

12. The apparatus of claim 11 wherein the position indicator is a spring detent having a tapered tip extending into a detent receiving groove within the cover receiving cavity; and wherein the detent has a tapered recess to receive the tip of the spring detent.

13. The apparatus of claim 1, wherein the cover and the housing makes a bayonet connection.

14. The apparatus of claim 1, wherein the cover is integral with the connecting end of the cable.

15. The apparatus of claim 1, wherein the cover is removably attached to the connecting end of the cable.

16. A method for making a safe connection between a connecting end of a power cable and a power connector comprising:

a) providing a cover mounted at the connecting end of the power cable;

b) providing a housing disposed over a power connector, the housing having a cover receiving cavity;

c) providing a switch adaptable to enable power transfer when the cover is inserted into the cover receiving cavity and rotated to a locked position;

d) connecting the connecting end of the power cable to the power connector while inserting the cover into the cover receiving cavity; and e) rotating the cover to the locked position to enable the switch and power transfer.

17. The method of claim 16 further comprising:

providing at least one detent extending radially outward from the cover to lock the cover in the cover receiving cavity and to enable the switch.

18. The method of claim 17 wherein the switch is enabled by rotating the cover so that the detent moves and depresses the switch.

19. The method of claim 17 wherein the cover includes first and second diametrically disposed detents having different shapes and the cover receiving cavity is correspondingly shaped to the outline of the cover with the differently shaped detents.

20. The method of claim 17, further comprising:

providing a cover position indicator disposed adjacent the cover receiving cavity to signal the cover in the locked position.

* * * * *

UNITED STATES PATENT AND TRADEMARK OFFICE

CERTIFICATE OF CORRECTION

PATENT NO : 6,053,756

DATED : April 25, 2000

INVENTOR(S): Flanigan et al.

It is certified that error appears in the above-identified patent and that said Letters Patent are hereby corrected as shown below:

In column 3, line 21, please replace "24" with -- 2-4 --.

Signed and Sealed this

Third Day of April, 2001

*Attest:*

Nicholas P. Godici

NICHOLAS P. GODICI

*Attesting Officer*

*Acting Director of the United States Patent and Trademark Office*